United States Patent [19]

Goncalves

[11] 4,386,696

[45] Jun. 7, 1983

[54] DEVICE FOR STORING SEPARATELY TWO PRODUCTS WHICH ARE TO BE DISPENSED SIMULTANEOUSLY

[75] Inventor: Antonin Goncalves, Groslay, France

[73] Assignee: L'Oreal, Paris, France

[21] Appl. No.: 946,215

[22] Filed: Sep. 27, 1978

Related U.S. Application Data

[63] Continuation of Ser. No. 771,632, Feb. 24, 1977, abandoned.

[30] Foreign Application Priority Data

Mar. 2, 1976 [FR] France ..... 76 05827

[51] Int. Cl.[3] ..... B65D 25/08

[52] U.S. Cl. ..... 206/221; 215/258; 215/DIG. 8; 206/219

[58] Field of Search ..... 206/219, 220, 221; 215/6, 227, 258, DIG. 8, 330; 220/23; 222/142.5

[56] References Cited

U.S. PATENT DOCUMENTS

| | | | |
|---|---|---|---|
| 908,822 | 1/1909 | Turner | 215/258 |
| 2,629,508 | 2/1953 | Prager | 215/DIG. 8 |
| 2,695,111 | 11/1954 | Voss | 215/330 |
| 3,326,400 | 6/1967 | Hamelin et al. | 206/221 |
| 3,684,455 | 8/1972 | Vacirca | 206/219 |
| 3,827,592 | 8/1974 | Deussen | 215/30 |

*Primary Examiner*—Joseph Man-Fu Moy
*Attorney, Agent, or Firm*—Brisebois & Kruger

[57] ABSTRACT

Device for storing separately at least two products which are to be dispensed simultaneously comprises a container defining a first compartment, a hollow closure for said container defining a second compartment, an ejectable capsule closing said second compartment, and an elastic collar carried by said hollow closure member and positioned to cause separation of said capsule from said second compartment when said hollow closure is removed from said container. The device is characterized by the fact that the collar is convex toward the bottom of the container and radially slotted to permit compression of the collar when it is forced through the neck of said container.

17 Claims, 6 Drawing Figures

DEVICE FOR STORING SEPARATELY TWO PRODUCTS WHICH ARE TO BE DISPENSED SIMULTANEOUSLY

This is a continuation, of application Ser. No. 771,632, filed Feb. 24, 1977, now abandoned.

SUMMARY OF THE INVENTION

This invention relates to a container for storing at least two solid or liquid products which are isolated from each other during storage but which it is desired to mix at the moment of use. More specifically, this invention relates to an improvement on the device described in French Pat. No. 1,419,762.

The device which is described in said French patent consists of a bottle, the neck of which is closed by means of a cap. This cap is fastened to the neck of the bottle by means of a cylindrical sleeve which is provided with internal threads cooperating with external threads on the neck of the bottle. A mounting skirt is attached to the surface of the circular top of the cap which faces the neck of the bottle and defines an opening which may be blocked by means of an ejectable capsule provided with an elastic cover the diameter of which is greater than the inner diameter of the neck of the container. In order to use a device of this type, the body of the container is filled with a first product, which is usually liquid, and the cap, positioned upside down, is filled with another powdered or liquid product which is positioned in the inner space delimited by the mounting skirt. After closing off this space with the ejectable capsule, the cap is screwed on the neck of the container, the mounting skirt and its associated capsule being, in the course of this step, seated inside the neck of the container. The collar, the external diameter of which is greater than the internal diameter of the neck, deforms during passage into the neck of the bottle to take a curved shape, the concavity of which is toward the inside of the cap. Once this has been done, the capsule is applied against its mounting skirt and cannot consequently be detached therefrom. When the cap has been screwed all the way down on the neck of the bottle, the collar of the capsule emerges from the neck of the bottle after having passed all the way through the neck of the bottle. It may then resume its original shape, which is substantially flat and perpendicular to the axis of the neck of the bottle. The assembly is then ready for storage, the two products contained, on the one hand, in the compartment formed by the inner space within the mounting skirt held in by its ejectable capsule, and, on the other hand, in the body of the container, being rigorously isolated from each other. When it is desired to mix the two products, it suffices to unscrew the cap which urges the collar against the inner edge of the neck of the container and consequently, the retention of the capsule at this level if one continues unscrewing the cap, the ejectable capsule becoming detached from its mounting skirt and falling into the container, which releases the product stored in the cap and assures the mixture of these products in the container. Distribution of this mixture may be carried out after having completely unscrewed the cap.

While the device described is particularly simple to manufacture, it has been found that it is not well adapted to insure in a reliable manner under all circumstances the separation of the capsule and the cap at the moment at which the latter is unscrewed, because of the structure of the collar with which the capsule is provided. In effect, at the moment at which the collar comes into abutment against the neck of the bottle, it is subjected at its edges to tractive forces which tend to deform the capsule in a direction opposite to that which prevailed during its passage in the opposite direction into the neck of the bottle, that is to say, the collar assumes a curvature, the concavity of which is this time toward the interior of the bottle. If one continues to unscrew the cap and if the capsule is forced into the mounting skirt, which is generally the case when it is desired to insure rigorous isolation of the two stored products, the deformation of the cap and its collar is such that its outer edge becomes lower at the inside of the neck of the bottle, which permits its passage into the neck of the bottle while the cap continues upwardly. The cap, no longer encountering an obstacle, remains attached to its mounting skirt and the two products are not mixed. To avoid the risk of such a defective operation, one may, of course, increase the outer diameter of the collar or reduce its deformability but this makes it difficult for the ejectable capsule to pass into the neck at the moment at which the cap is screwed onto the bottle. It is also possible to reduce the grip between the capsule and its mounting skirt, but this leads to the risk that the device will not serve its function by rigorously isolating two products during storage and moreover, the capsule may accidentally become detached from its mounting skirt as a consequence of external shocks or vibrations to which the container may be subjected during its transport or handling.

It is the object of the present invention to overcome the foregoing disadvantages and to this end it is intended to provide a device of the type described in French Pat. No. 1,419,762, which is capable of operating reliably regardless of the gripping force between the ejectable capsule and its mounting skirt, so as to insure that the operation of separating the cap from the bottle necessarily leads to the release of the capsule from the cap and its falling into the bottle. To this end, in the device according to the invention, the ejectable capsule is associated with a collar having the essential characteristics of being concave toward the interior of the cap and comprising at least one substantially radial slot. The introduction of the cap associated with such a collar into the neck of the container is especially facilitated by reason, on the one hand, of its concavity, and, on the other hand, of the presence of radial slots which permit free contraction of the external perimeter of the collar until it has reached an outer diameter near or at least equal to the inner diameter of the neck. In effect, the width of the radial slots is selected so that their sum is substantially equal to the difference between the inner perimeter of the neck and the outer perimeter of the unstressed collar. During the opposite maneuver, that is to say when it is desired to mix the two products stored in the container, the collar comes into contact with the neck and, while the cap pursues its upward movement, it has a tendency to deform elastically to take, because of the constraint exerted, a flat configuration perpendicular to the axis of the neck of the bottle, which imparts thereto an external perimeter greater than that of its original configuration. The increase in the external perimeter compensates largely for any possible contraction permitted by the presence of the radial slots and makes it possible to lock the collar on the neck of the bottle and thus, cause disengagement of the ejectable capsule on its mounting skirt so that it falls into the container.

It is accordingly an object of the present invention to provide a device for storing at least two solid or liquid products which are isolated from each other during storage, and which are to be mixed only at the moment of use, said device comprising a container, the neck of which is blocked by a member, the body of the container constituting a first compartment in which one of the products is placed, and said member being provided with a mounting skirt blocked by an ejectable capsule and defining with said capsule a second compartment in which the other product is placed. An elastic collar, the outer dimension of which is greater than the inner dimension of the neck of the container, is removably seated on the member and positioned beyond the neck of the container when the member is completely attached to said container, the collar being capable, moreover, during separation of the member from the container, of coming into abutment against the end of the container neck in order to cause separation of the ejectable capsule from its mounting skirt so that it falls into the body of the container. This collar has a curved form the convexity of which is turned toward the body of the container and characterized by the fact that the collar comprises at least one radial slot, the sum of the widths of the slots being substantially equal to the difference between the minimum inner perimeter of the neck and the external perimeter of the collar.

In an advantageous embodiment, the collar is provided with several regularly spaced radial slots in the collar is made of a flexible deformable material such as polyethylene for example, the ejectable capsule is made in the shape of a bowl, the lateral wall of said bowl being, at its free end, adjusted in the opening in the mounting skirt, the lateral wall of the adjustable capsule comprises peripheral external sealing ridges which snap into corresponding grooves provided on the inner surface of the mounting skirt, the neck of the container has an inner diameter which progressively decreases in the direction of the body of the container, and the external diameter of the collar lies between the maximum and minimum diameters of the neck. In a first variation, the collar is fixed to the ejectable capsule. The ejectable capsule and its associated collar may be advantageously made by molding from a flexible plastic material such as polyethylene for example. However, to the extent to which the capsule is adapted to contain a liquid in which a dye is dissolved, the capsule and its associated collar may also be made of polyvinylchloride, a material which resists the migration of the dye and its solvent.

In an advantageous variation of this first embodiment, the ejectable capsule comprises on that part of its lateral wall which is not inserted in the mounting skirt, a sheath positioned concentrically of its lateral wall, and a collar forming the edge of the sheath which is positioned at the bottom of the capsule. The radial slots which are formed in the wall of the collar extend into the wall of the sheath. Because the radial slots formed in the collar extend into the wall of the sheath, so that the contraction of the external perimeter of the collar is facilitated the moment at which it passes into the neck of the container. The collar-carrying sheath is preferably made of polyethylene because of the elasticity which this type of material imparts. The capsule and its associated collar may be made in a single piece but it is also possible to make the capsule and the collar two distinct pieces which are held together by means of the sheath. In this case the collar may be made of a flexible material while the capsule is made of a relatively rigid material dependent on the chemical nature of the products which it is designed to contain, for example of glass, metal or polyvinylchloride.

In a second variation of this embodiment a separate sleeve is removably mounted on the external surface of the mounting skirt, the edge of the sleeve which is closest to the body of the container carrying the collar associated with the capsule. The ejectable capsule comprises a peripheral external ring bearing against the edge of the mounting skirt, said ring having an external diameter greater than the inner diameter of the separate sleeve, the collar being positioned between the neck of the container and said ring. The radial slots formed in the wall of the collar extend into the wall of the separate sleeve up to the zone at which it is fixed to the mounting skirt. In this case the ejectable capsule and the separate sleeve constitute two independent pieces. The separate sleeve is preferably made of polyethylene while the ejectable capsule is made of a material compatible with the powdered or liquid product with which it is to come into contact, for example glass, metal or polyvinylchloride.

In a first variation of the first and second embodiments the member which blocks the neck of the container is a cap, the surface of the cap facing the body of the container being provided with a mounting skirt. The cap comprises a substantially cylindrical external sleeve positioned along the axis of the neck of the container, when the cap is mounted on the latter, said sleeve being provided with inner threads which cooperate with external threads formed on the neck of the container.

In a second embodiment of the first and second variations, the member which blocks the neck of a container is a bottle, the neck of which is positioned inside the neck of the container, and is closed by the ejectable cap. The neck of the bottle has external threads which cooperate with internal threads on the neck of the container. The neck of the bottle has externally, between its threaded part and its zone of connection to the body of the bottle, a peripheral flange capable of sliding inside an annular groove provided on the internal face of the neck of the container. On the annular flange are provided peripheral sealing ribs which frictionally cooperate with the bottom of the groove. The container is made of polyethylene while the bottle associated therewith is made of polyvinylchloride.

In this second embodiment one substitutes for the cap used in the first embodiment a bottle into which there is preferably introduced, by reason of its greater volume, a liquid product. Thus such a device is more particularly adapted to the storage of two liquid products isolated from each other and which are not to be mixed until the moment of use.

In order that the object of the present invention may be better understood, several embodiments thereof will now be described, purely by way of illustration and example, with reference to the accompanying drawings, on which:

Figure 5:
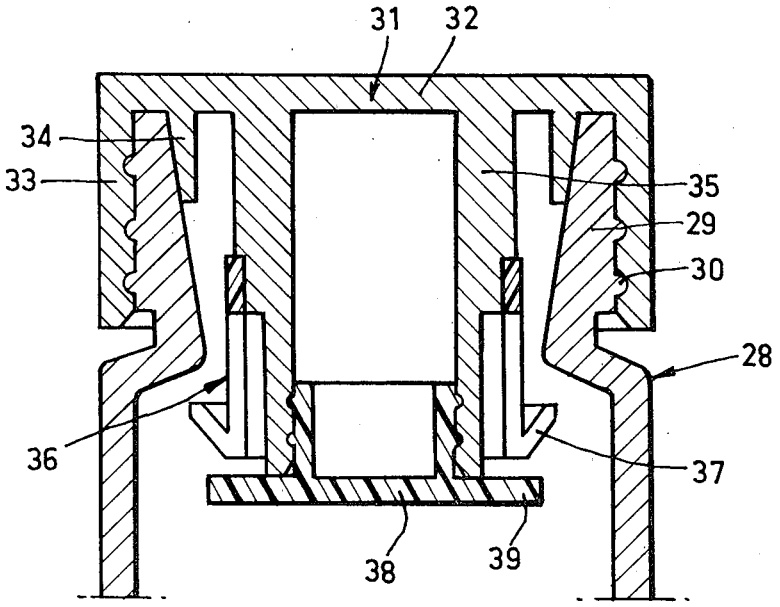
Figure 6:
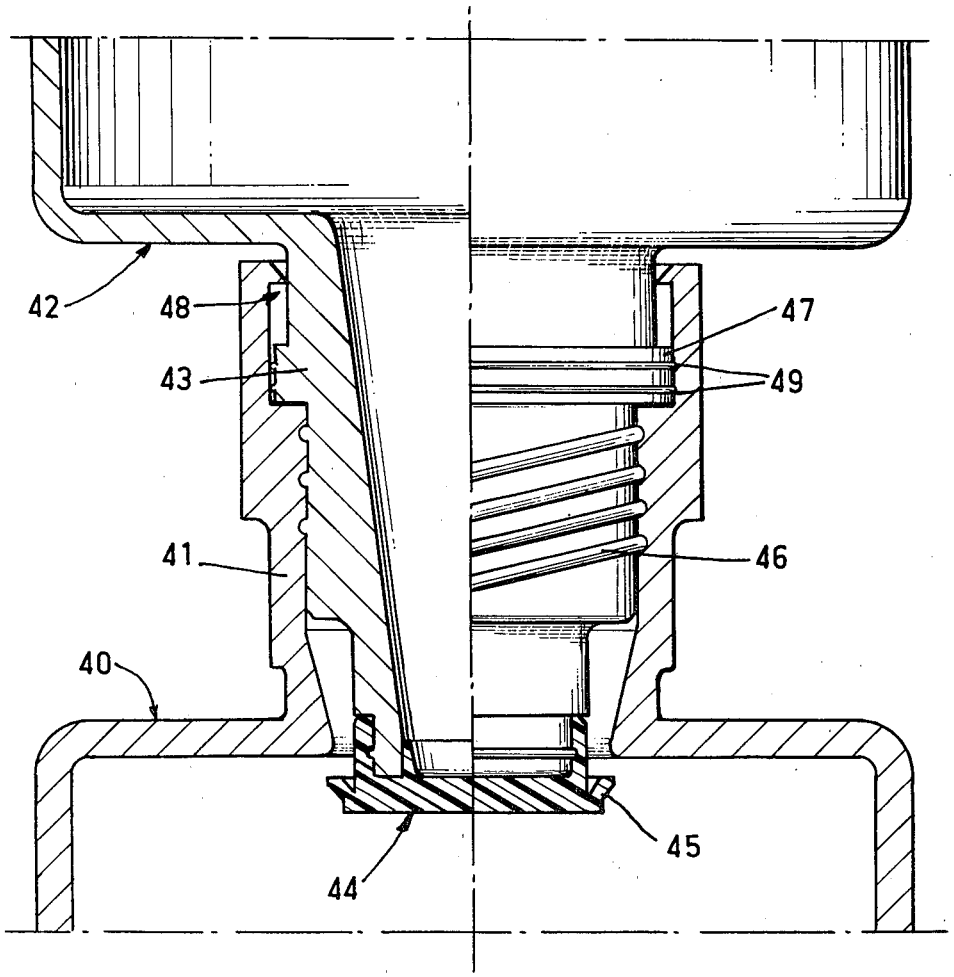

FIG. 5 shows in axial section a second variation of the embodiment of a storage device according to the invention in storage position, a sleeve to the edge of which the collar is connected being seated on the mounting skirt of the ejectable capsule; and FIG. 6 shows partially in axial section another variation of the first embodiment in which another bottle is substituted for the cap which blocks the neck of the container.

Figure 1:
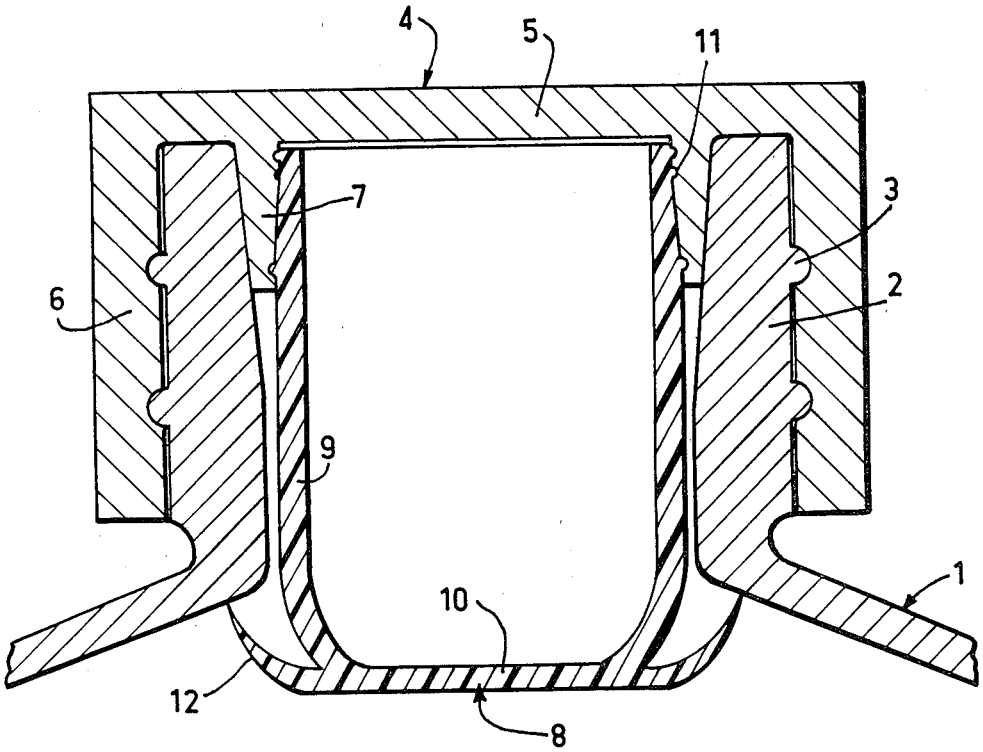
FIG. 1 is a partial view in axial section through the first embodiment of a storage device according to the invention in storage position, the ejectable cap being fixed to a collar.
Figure 2:
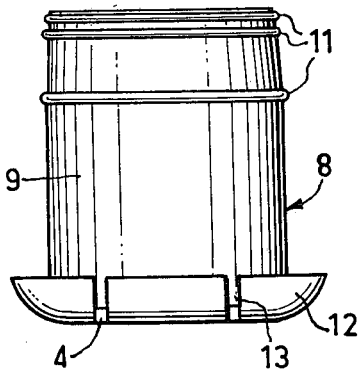
FIG. 2 is an elevational view of the ejectable cap with which the device of FIG. 1 is equipped.

Referring now to FIGS. 1 and 2 it will be seen that reference numeral 1 indicates a bottle adapted to hold a preferably liquid product. The neck 2 of the bottle 1 has external threads 3. The inner diameter of the neck 2 decreases progressively in the direction of the bottom of the container.

A cap 4 adapted to close the neck 2 of the container has a circular top 5 to the edge of which is connected an external substantially cylindrical sleeve 6, the axis of which is the same as that of the neck 2. The sleeve 6 has internal threads adapted to cooperate with the said external threads 3. On the surface of the circular top 5 facing the neck of the bottle is a mounting skirt defining an opening in which an ejectable capsule 8 is inserted. The mounting skirt 7 and the external sleeve 6 are coaxial. The skirt 7 is adjusted in the opening of the neck 2 when the cap 4 is screwed down on the latter, so as to insure a good seal between the cap 4 and the neck of the container. The ejectable capsule 8 which is fixed to the cap 4 during storage is a cup the lateral wall 9 of which is substantially cylindrical and extends toward the cap 4. The capsule 8 has a wall height greater than that of the neck 2 of the container and its bottom 10 which is perpendicular to the axis of the neck 2, is positioned outside the latter. The zone of the lateral wall 9 which is inserted inside the mounting skirt 7 has three external peripheral seals 11 which snap into corresponding grooves in the internal surface of the mounting skirt 7. The ejectable capsule 8 is before it is attached to the cap 4, filled with a liquid or powdered product adapted to form, with the first product in the body of the container 1, a mixture which it is desired to dispense.

The ejectable capsule comprises, substantially in the plane of its bottom 10, a peripheral collar 12, the external dimension of which lies between the inner dimension of the upper edge of the neck 2 and the outer dimension of its lower edge. The cap 8 and its associated collar 12 are made in a single piece by molding from polyethylene. One of the essential peculiarities of this collar 12 is that of having, when the ejection capsule is seen in axial longitudinal section in the position shown in FIG. 1, a curved shape the convexity of which is turned toward the bottom of the container. The collar 12 has a wall thickness which decreases in the direction of its free edge. The collar 12 is discontinuous because of the presence of four radial slots formed in its wall and regularly spaced from each other. The four radial slots are so dimensioned that the sum of their widths is substantially equal to the distance between the inner perimeter of the neck measured in its narrowest zone and the outer perimeter of the collar in a free state so as to make possible, as will be hereinafter explained in a more detailed manner, a contraction of the collar during its passage through the neck of the container when the cap is screwed on the latter.

The mounting of the storage container which has just been described takes place in the following manner.

A first product is positioned in the body of the container and a second product is positioned inside the capsule 8. The capsule 8 is then introduced into the cap 4 and is attached inside its mounting skirt 7 by snap fitting the seals 11 in the corresponding grooves.

The cap 4 is then screwed on the neck 2 of the container. The orifice defined by the neck is outwardly tapered in its upper part so that the centering of the ejectable capsule 8 and its associated collar 12 is facilitated. The collar 12 deforms at the moment at which the capsule passes along the neck of the bottle, this deformation being such that the original convexity is accentuated, that is to say that the collar 12 tends to be applied against the lateral wall 9. Such a deformation would not however be sufficient to permit the free passage of the collar into the neck of the bottle. The passage of the collar 12 is assured essentially by the contraction of its external perimeter which is permitted by the four radial slots 13. Since the sum of the widths of these four radial slots is equal to the difference between the external perimeter of the collar and the minimum internal perimeter of the neck of the container the collar, by reason of the contraction of the four radial slots 13, has a diameter which adjusts to that of the neck and this has the effect of permitting the cap to be positioned on the container more easily. In order to mix the two separate products contained respectively in the cap and in the body of the container, the cap is unscrewed, which brings the collar against the inner edge of the neck of the container, and consequently causes retention of the ejectable capsule. Contrary to the previously patented device, the collar has a tendency, because of its elasticity, to assume a configuration which is substantially flat and perpendicular to the axis of the capsule, that is to say to have an outer perimeter greater than that of its original configuration when it was not subject to any traction. Thus, the more the traction exerted is increased, the more the outer perimeter of the collar increases, so that there is an effective retention of the collar against the neck of the bottle. As one continues to remove the cap 4 by unscrewing it, the capsule becomes detached from its mounting skirt 7 and falls into the body of the container, bringing with it as it falls the product which was held therein. The two products now in contact with each other may be mixed by simply shaking the container and the mixture may be distributed by completely unscrewing the cap 4.

Figure 4:
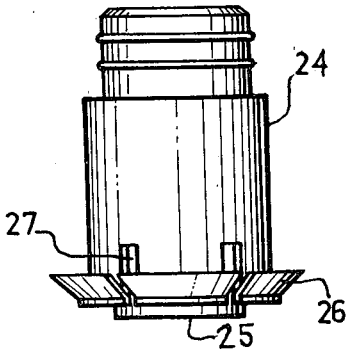
FIG. 4 shows in elevation the ejectable capsule of FIG. 3.
Figure 3:
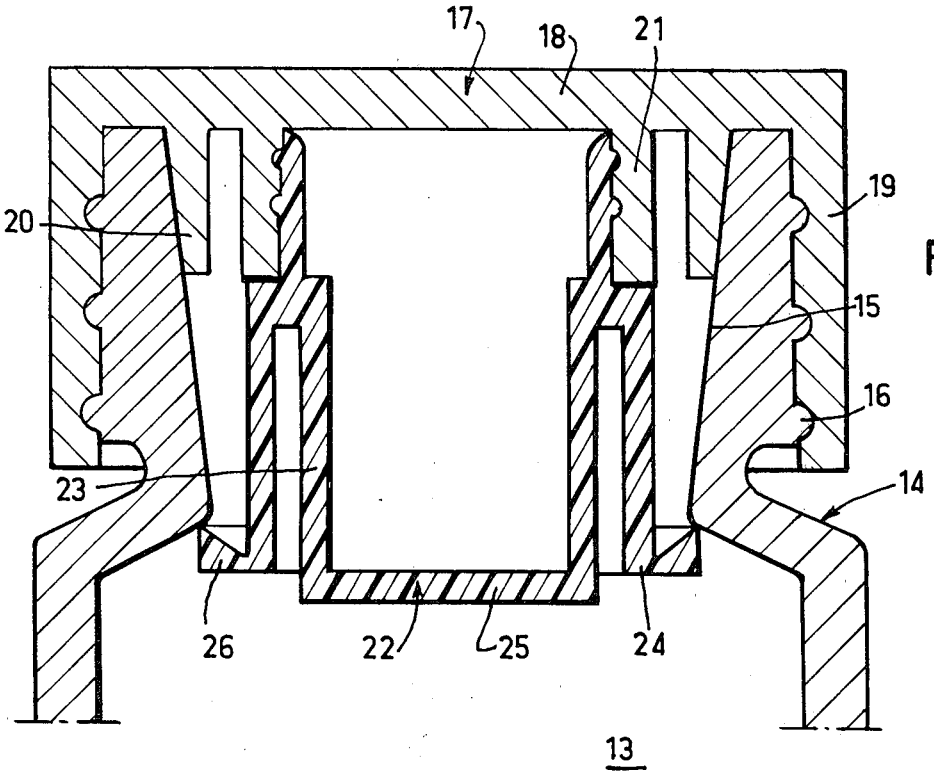
FIG. 3 is a partial axial sectional view of another variation of the first embodiment, the device being illustrated in storage position, the collar being carried by a sleeve fixed to the ejectable capsule.

Referring now to FIGS. 3 and 4 it will be seen that this illustrates another variation of the first embodiment of the invention. In this variation, the collar is carried by a sleeve fixed to the ejectable capsule.

This device comprises a container 14 adapted to hold a first preferably liquid product. The neck 15 of the container 14 has an inner diameter which decreases progressively in the direction of the bottom of the container so as to facilitate centering and depression of the ejectable capsule and its associated collar. The neck 15 has external threads 16.

The cap 17 mounted on the neck of the container, comprises a circular top 18 to the edge of which a substantially cylindrical outer sleeve is connected. This sleeve is provided with internal threads adapted to cooperate with the external threads 16 of the neck 15. To the inner surface of the circular cap 18 is connected a sealing ring 20 having a generally cylindrical shape which is adjusted against the internal wall of the neck of the container during screwing of the cap 17 thereon. A mounting skirt 21 is also attached to the surface of the top 18 and is coaxial with the sealing ring 20. The ejectable capsule 22 which is fixed to the cap 17 during storage, is made in the form of a cup the lateral cylindrical wall 23 of which extends towards the cap 17. The lateral wall 23 has, in the zone which is inserted into the mounting skirt 21, two peripheral sealing ridges which snap into corresponding grooves on the internal surface of the mounting skirt 21. The zone of the lateral wall 23 which is not fitted to the inside of the mounting skirt 21 is encircled by a sleeve 24 coaxial with the capsule. The sleeve 24 has an external diameter substantially equal to the external diameter of the mounting skirt 21 and comprises, near the end 25 of the capsule, a collar 26 analogous to the one already described in FIGS. 1 and 2. This collar 26, the outer diameter of which is greater than the inner diameter of the neck of the container, has, when the ejection capsule is seen in axial longitudinal section, a shape such that its convexity is turned toward the body of the container. The angle which the upper surface of the collar makes with the sleeve 24 to which it is connected is about 45°. In the wall of the collar 26 are formed four radial slots 27 which extend into the wall of the sleeve 24. The four radial slots 27 positioned at 90° intervals are so dimensioned that the sum of their widths is substantially equal to the difference between the inner perimeter of the neck measured in its narrowest zone and the outer perimeter of the collar, in order to make possible, as has been above described, the free passage of the collar during screwing of the cap 17 onto the neck of the container.

The sleeve 24 and its associated collar may advantageously be made of polyethylene. The sleeve 24 may be, in another embodiment not shown, a separate piece mounted on the cap 22 and the latter may then be made of any material compatible with the product which is to be contained. Among the materials from which the cap 22 may be made are glass, metals such as aluminum, and plastic materials such as polyethylene and polyvinylchloride.

The mounting and functioning of the storage container which has just been described are identical to those of the first variation of the embodiment of FIGS. 1 and 2.

Referring now to FIG. 5, it will be seen that this shows a second embodiment comprising a sleeve the emerging part of which is formed by the deformable collar, and which is seated on the mounting skirt of the ejectable capsule. This device comprises a container 28 adapted to hold a first preferably liquid product. The neck 29 of the container is internally tapered and has an external thread 30. The cap 31, having a generally cylindrical shape, is screwed onto the neck 29 and comprises a circular top 32 to the edge of which is connected an external sleeve 33 provided with internal threads which cooperate with said threads 30. On the surface of the circular top which faces the neck of the bottle is a sealing ring 34 which bears against the internal surface of the neck 29 when the cap is screwed thereon. On the surface of the circular top 32 is also connected a skirt 35 the external diameter of which is less than the diameter of the sealing skirt 34. The skirt 35, which has the same axis as the sealing ring 34, extends, when the plug 31 is screwed down on the neck 29 of the container, beyond the neck 29 onto the body of the container.

A particular feature of this variation resides in the fact that a separate sleeve 36 is removably seated on the outer face of the skirt 35. The sleeve 36 comprises, on its edge which is furthest from the body of the container, a collar 37 the external perimeter of which is greater than the inner perimeter of the neck 29, measured in its narrowest zone. The collar 37 has a shape the convexity of which is turned toward the body of the container. In the wall of the collar 37 are formed four radial regularly spaced slots which extend into the wall of the sleeve 36 up to the level of the zone at which it is attached to the skirt 35. In the opening in the mounting skirt 35 is seated an ejectable capsule 38, the lateral wall of which carries peripheral seals which snap into two corresponding grooves in the internal surface of the mounting skirt 35. In the plane of its end, the capsule 38 has a peripheral external ring 39 bearing against the edge of the mounting skirt 35. The external ring 39 has an outer diameter less than the minimum diameter of the neck 29.

The storage container according to this variation is mounted in the following manner.

A first product is placed inside the body of the container and a second product is placed inside the recess defined by the mounting skirt 35. The cap is held upside down. The separate sleeve 36 which is to grip the external surface of the mounting skirt 35 is introduced into the outer sleeve 33. The ejectable capsule 38 is then inserted in the opening in the mounting skirt 35 and its two peripheral seals are snapped into the two corresponding grooves.

The cap equipped in this manner is turned right side up and positioned above the neck of the container. The screwing of the cap onto the neck of the container makes it possible to exert a sufficient force to insure the contraction of the outer perimeter of the collar during its passage into the neck of the container.

When it is desired to make the mixture of the two products contained respectively in the mounting skirt which is closed by the ejectable capsule 38 and in the body of the bottle, the cap 31 is unscrewed. The collar 37 bears on the neck of the bottle and is held at this level. The cap continues its upward movement, the separate sleeve 36 separates from the mounting skirt 35 and comes into abutment against the external ring 39 of the ejectable capsule 38 which it pushes so that the capsule falls into the body of the container, the separation of the capsule and the cap leading to a mixture of the products initially contained in the container, on the one hand, and in the cap, on the other hand. Complete unscrewing of the cap and its removal from the container result in dispensing of the mixture through the neck 29.

In another embodiment it is also possible to provide the cap with a dispensing spout defining a space within it which communicates with that in the mounting skirt. At the moment of distribution of the mixture the cap may then rest in place on the neck of the container. By cutting off a frangible ball provided at the end of the dispensing spout an outlet is created for the mixture contained in the bottle.

Referring now to FIG. 6 of the drawings, it will be seen that this shows a second variation of the first embodiment of the invention in which a bottle replaces the cap (4, 17 or 31) associated with the storage container.

The device illustrated on FIG. 6 comprises a container 40 made of polyethylene and adapted to hold a first liquid product. This container 40 is provided with a neck 41 having, in the zone in which it is connected to the body of the container, a narrowed section of small diameter.

A second liquid product is placed in a bottle 42 having a neck 43 closed by an ejectable capsule 44. In the wall of the ejectable capsule 44 is an annular groove into which the edge of the neck 43 snaps. The ejectable capsule 44 has near its bottom a collar 45 analogous to the one already described in FIGS. 1 to 4. This collar 45, the external diameter of which is greater than the minimum internal diameter of the neck of the container 40, has a curvature the convexity of which is turned toward the bottom of the container 40. The upper surface of the collar forms an angle of about 45° with respect to the lateral wall of the ejectable capsule to which it is attached. In the wall of the collar 45 are four radial slots (not shown) positioned at 90° intervals.

The neck 43 of the bottle 42 has an external male thread 46 which cooperates with an internal female thread formed on the neck 41. On the neck 43 between its threaded part and the zone of connection to the body of the bottle is formed a continuous flange 47. This rib 47 is capable of sliding inside the peripheral annular groove 48 formed on the internal surface of the neck 41 in the end thereof remote from the bottom of the container 40. The peripheral annular groove 48 lies between two parallel shoulders which limit the movement of the neck 43 inside the neck 41. On the annular flange 47 are provided two peripheral sealing ridges 49 which frictionally cooperate with the wall of the annular groove 48. The storage device illustrated on FIG. 6 is assembled in the following manner. The two liquid products to be mixed are placed respectively inside the container 40 and inside the bottle 42. The neck 43 of the bottle 42 is closed by inserting the ejectable capsule 44. The bottle 42 is then turned upside down and presented in this position above the container. Then the neck 43 is lowered and screwed into the neck 41 until the annular flange comes into abutment against the lower shoulder of the annular groove 48, the collar 45 of the ejectable capsule 44 being then inside the body of the container 40.

When it is desired to mix the two liquid products contained, on the one hand, in the container 40 and, on the other hand, in the bottle 42 associated therewith, the bottle is unscrewed, that is to say, the neck 43 is caused to rise inside the neck 41 by unscrewing it. The collar 45 fixed to the ejectable capsule 44 comes to bear against the neck of the container 40 and is held at this level. If the bottle 42 continues to be unscrewed, the ejectable capsule becomes detached from the edge of the neck 43 and falls into the container 40, which releases the liquid product stored in the bottle 42 and assures the mixture of these two products in the container 40. If unscrewing is still further continued, the annular rib comes into abutment against the upper shoulder of the annular groove 48 which has the effect of preventing the complete separation of the bottle 42 and the container 40.

It should be noted that the device which has just been described makes it possible to obtain a seal during and after the operation of mixture, even when the upper bottle is poorly screwed back on, because of the existence of the flange 47 which frictionally cooperates by means of its two sealing ridges 49 with the bottom of the annular groove 48. The mixture may be distributed in a conventional manner through an outlet covered by a cap, or a dispensing spout. These members may just as well be provided on the container 40 as on the bottle 42 of such a device.

It will of course be appreciated that the embodiments hereinbefore described have been given purely by way of example, and may be modified as to detail without thereby departing from the basic principles of the invention.

What is claimed is:

1. In a device for storing at least two products which are isolated from each other during storage and which it is not desired to mix until the moment of use, said device comprising:

a container having a neck and a body constituting a first compartment in which one of the products may be placed;

a member closing said neck and supporting an ejectable element, said member and said ejectable element defining a second compartment and in which the other product may be placed;

a one piece elastic collar the external dimension of which is greater than an internal dimension of the neck of the container, said collar being removably carried by said member in a position which is beyond the neck of the container when the member is in closed position on said container, the collar being adapted, during separation of the member from the container, to come into abutment against an end of the neck of the container to cause separation of the ejectable element from the member, said collar during insertion through the neck being convex toward the body of the container;

the improvement according to which said collar has a diverging upper surface inclined upwardly toward the end of the neck when the member is in said closed position on the container, the collar comprises at least one radial slot, the total width of said at least one slot being substantially equal to the difference between the inner perimeter of the neck at its narrowest point and the external perimeter of the collar when free from constraint, said collar comprising means for readily folding upwardly and inwardly during insertion of the collar through the neck, and said upper surface of said collar comprising elastic means for deforming to expand radially outwardly against the end of the neck as a result of upward movement during separation of said member from the container.

2. Device as claimed in claim 1 characterized by the fact that the collar is provided with a plurality of regularly spaced radial slots.

3. Device as claimed in claim 1 in which the collar is made of a flexible deformable material such as polyethylene.

4. Device as claimed in claim 1 in which the ejectable element is in the shape of a cup the free end of the lateral wall of said cup being fitted on an end of a mounting skirt of said member.

5. Device as claimed in claim 4 in which a lateral wall of the ejectable cup comprises peripheral external sealing ribs which snap into corresponding grooves in the internal surface of the mounting skirt.

6. Device as claimed in claim 1 in which the neck has an inner diameter which decreases progressively in the direction of the body of the container, the external diameter of the collar when free from constraint lying between the maximum and minimum diameters of the neck.

7. Device as claimed in claim 1 in which the collar is fixed to the ejectable element.

8. Device as claimed in claim 4 in which that portion of the lateral wall of the ejectable element not fitted on the mounting skirt carries a sleeve positioned concentrically of its lateral wall, said collar forming the edge of the sleeve near the bottom of the capsule.

9. Device as claimed in claim 8 in which the radial slots are formed in the wall of the collar and extend into the wall of the sleeve.

10. Device as claimed in claim 1 which comprises a separate sleeve which is seated removably on an external surface of a mounting skirt of said member, the edge of the sleeve which is nearest the body of the container carrying the collar.

11. Device as claimed in claim 10 in which the ejectable element comprises an external peripheral ring which comes to bear against the edge of the mounting skirt, said ring having an outer diameter greater than the inner diameter of the separate sleeve, the collar being positioned between the neck of the container and said ring.

12. Device as claimed in claim 10 in which the radial slots are formed in the wall of the collar and extend into the wall of the separate sleeve up to the zone in which it is attached to the mounting skirt.

13. Device as claimed in claim 1 in which the member closing the neck of the container is a cap, the surface of the cap facing the body of the container being provided with a mounting skirt.

14. Device as claimed in claim 13 in which the cap includes a substantially cylindrical external sleeve positioned coaxially of the neck of the container when the cap is mounted thereon, said sleeve being provided with inner threads which cooperate with the external threads formed on the neck of the container.

15. Device as claimed in claim 1 in which the member which closes the neck of the container is a bottle the neck of which, positioned inside the neck of the container, is closed by the ejectable capsule.

16. Device as claimed in claim 15 in which the neck of the bottle comprises an external thread which cooperates with an internal thread on the neck of the container.

17. Device as claimed in claim 15 in which the neck of the bottle comprises an annular flange positioned externally between its threaded part and the body of the bottle, said flange being adapted to slide axially inside an annular groove on the internal surface of the neck of the container.

* * * * *